US009683712B2

(12) United States Patent
Trittis et al.

(10) Patent No.: US 9,683,712 B2
(45) Date of Patent: Jun. 20, 2017

(54) CANDLE LANTERN WITH SPARE CANDLE STORAGE CHAMBER

(75) Inventors: Dino Trittis, Renton, WA (US); Dave Marriner, Texas Creek, CO (US)

(73) Assignee: Industrial Revolution, Inc., Tukwila, WA (US)

( * ) Notice: Subject to any disclaimer, the term of this patent is extended or adjusted under 35 U.S.C. 154(b) by 961 days.

(21) Appl. No.: 13/350,732

(22) Filed: Jan. 13, 2012

(65) Prior Publication Data

US 2012/0230042 A1 Sep. 13, 2012

Related U.S. Application Data

(60) Provisional application No. 61/433,112, filed on Jan. 14, 2011.

(51) Int. Cl.
*F21V 21/00* (2006.01)
*F21L 19/00* (2006.01)
*F21S 13/12* (2006.01)

(52) U.S. Cl.
CPC ..... *F21L 19/00* (2013.01); *F21S 13/12* (2013.01)

(58) Field of Classification Search
CPC ..... F21V 19/00
USPC ..... 362/163, 180, 181
See application file for complete search history.

(56) References Cited

U.S. PATENT DOCUMENTS 5,688,040 A 11/1997 Klees
5,722,763 A 3/1998 Chen
6,030,093 A 2/2000 Draper
6,688,035 B1 * 2/2004 Shichman ..... 43/112

OTHER PUBLICATIONS

UCO Candle Lanterns, website screenshot, Jan. 7, 2010, <www.candlelantern.com>.
Original Candle Lantern, website screenshot, Feb. 28, 2009, <www.candlelantern.com/original.html>.
UCO Original Candle Lantern plus LED, website screenshot, Mar. 2, 2009, <www.candlelantern.com/led.html>.
Mini Lantern, website screenshot, Feb. 12, 2009, <www.candlelantern.com/mini.html>.
Candlelier, website screenshot, May 22, 2009, <www.candlelantern.com/candlelier.html>.

* cited by examiner

*Primary Examiner* — Joseph L Williams
(74) *Attorney, Agent, or Firm* — DWC Law Firm, P.S.; David Chen

(57) ABSTRACT

A collapsible candle lantern having a spare candle storage compartment. The candle storage compartment can be defined by a base and a cap. A candle bracket can be attached to the cap. The base can have partial annular walls and an interior annular wall.

14 Claims, 4 Drawing Sheets

CANDLE LANTERN WITH SPARE CANDLE STORAGE CHAMBER

CROSS REFERENCE TO RELATED APPLICATION(S)

This application claims the benefit of U.S. provisional patent application Ser. No. 61/433,112, filed Jan. 14, 2011, which is incorporated herein by reference in its entirety.

BACKGROUND

1. Technical Field

The present disclosure relates generally to a lantern, and in particular, a candle lantern.

2. Description of Related Art

Tea-light candles are typically used to provide low level lighting or heating. They are generally inexpensive, compact, and efficient due to their structure. For example, tea-light candles can include a thin outer cup or casing, typically metallic (e.g., aluminum), encasing the wax of the candle, with a wick being anchored to the bottom of the cup. The small volume of wax within the cup can completely liquefy but still be retained proximate the wick within the cup to help ensure continued burn of the wax. This efficient structure has made tea-light candles very popular and they are in widespread use. Tea-lights, as well as other types of candles, are often burned within lanterns. However, the storage and transportation of such lanterns can be tedious unless they are compact. This can be especially true for outdoor use, such as in hiking and camping, wherein light weight compact equipment is highly desirable.

BRIEF SUMMARY OF THE DISCLOSURE

Some embodiments of the present disclosure comprise a lantern. The lantern can have an annular frame member. A plurality of retaining arms can extend vertically downward from the annular frame member. A roof member can be located near a top portion of the lantern. A plurality of downwardly slopped arms can connect the roof member to the annular frame member. Furthermore, a transparent chimney can be disposed within the annular frame member and retaining arms.

In some embodiments, the lantern also comprises a base canister to which the retaining arms are slidably attached, to allow a user to collapse (retract) or extend the chimney with respect to the base canister.

In some embodiments, a candle holder can be releasably connected to the base canister, to support a candle for burning within the lantern. The candle holder can include a cap releasably attachable to a base, and a spare candle can be stored within the cap.

DETAILED DESCRIPTION

In the following description, certain specific details are set forth in order to provide a thorough understanding of various embodiments of the disclosure. However, upon reviewing this disclosure, one skilled in the art will understand that the disclosure may be practiced without many of these details. In other instances, some well-known materials of construction, structures and methods associated with lanterns have not been described in detail to avoid unnecessarily obscuring the descriptions of the embodiments of the disclosure.

Figure 1:
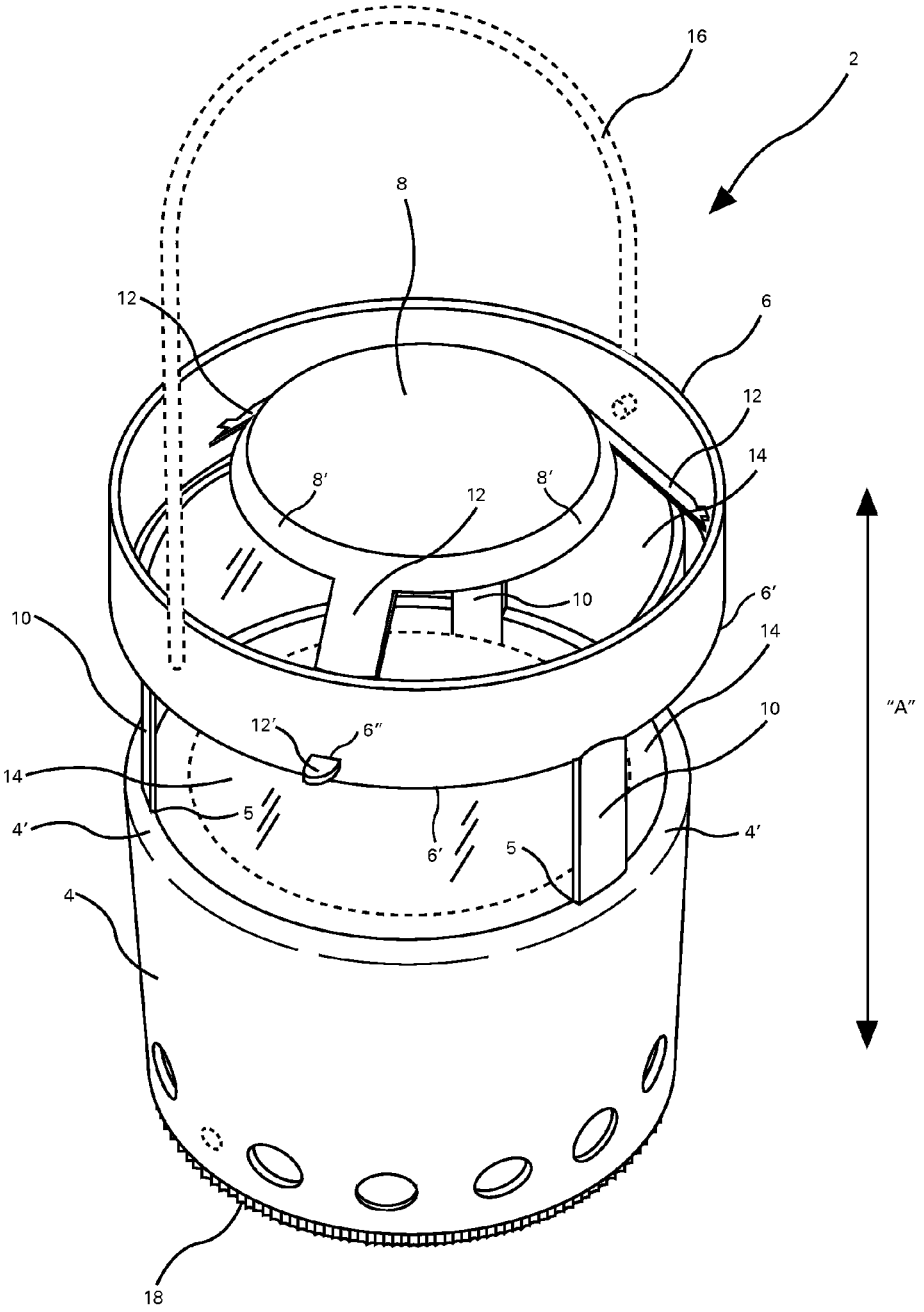
FIG. 1 is a perspective view of an embodiment of the lantern of the present disclosure with the chimney in an extended position.
Figure 2:
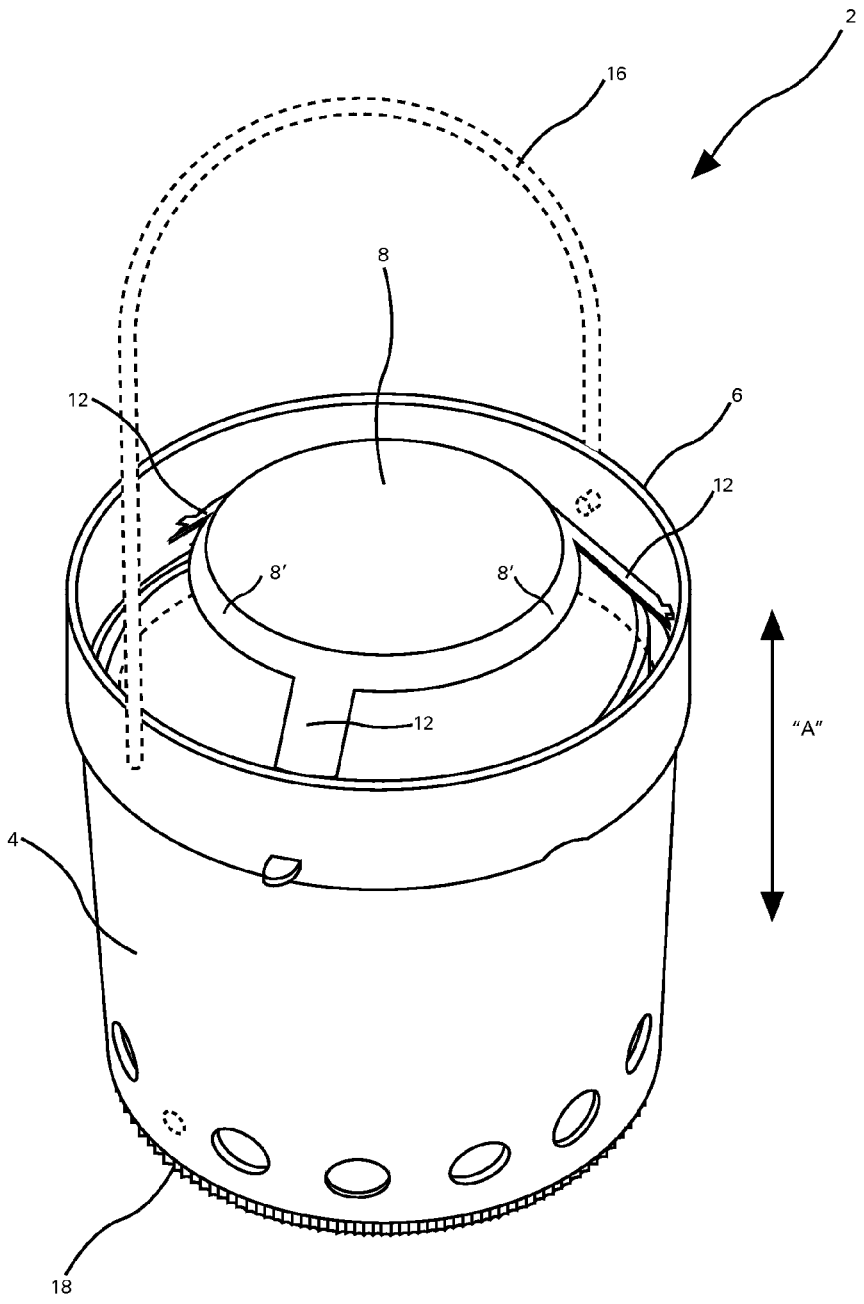
FIG. 2 is a perspective view of the lantern of FIG. 1, with the chimney in a retracted position.

Referring to FIGS. 1 & 2, the present disclosure is directed toward a collapsible lantern 2, which can be used to house candles, such as tea-light candles. Other types of candles may also be used with the lantern of the present disclosure, as will be appreciated by those skilled in the art after reviewing this disclosure, provided that the lantern and its parts are sized accordingly.

Still referring to FIG. 1, in some embodiments, the lantern 2 can include a chimney 14, which can be a substantially transparent cylinder made of plastic, glass or other suitable material. In certain embodiments, the chimney 14 can be made of a material partially transparent, diaphanous, or sufficiently translucent to allow light to pass through the material. The chimney 14 can be attached to a chimney frame which can comprise an annular frame member 6 having downwardly extending elongated retaining arms 10 and a circular shaped reflective roof 8 connected to the annular frame member 6.

Figure 3A:
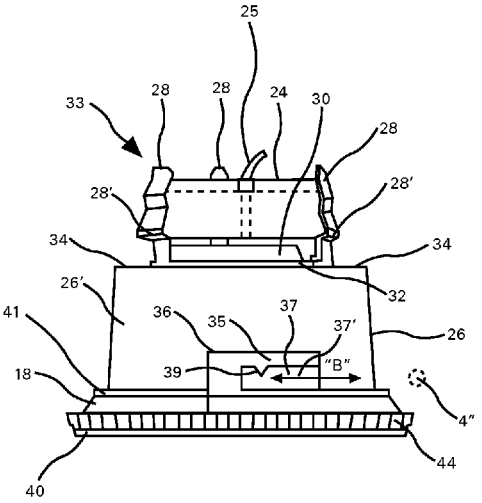
FIG. 3*a* is a side elevation view of the candle holder for an embodiment of the present disclosure.
Figure 3:
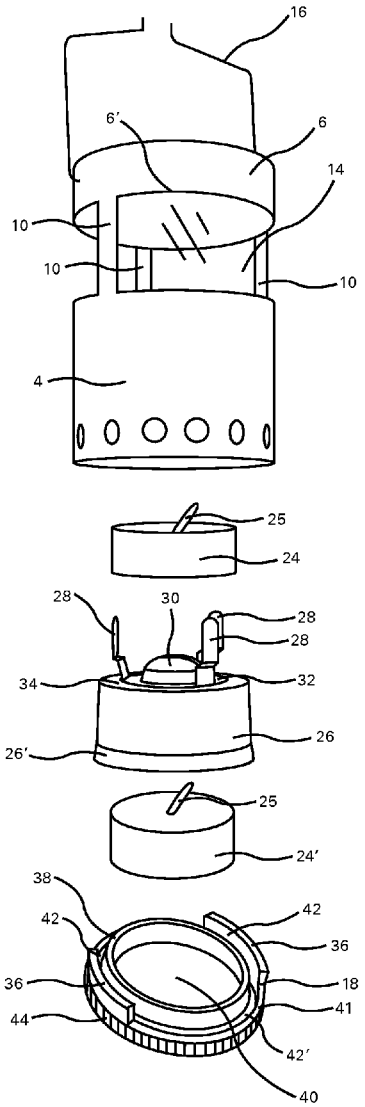
FIG. 3 is an exploded perspective view of the lantern of FIG. 1.

In some embodiments, there are three elongated retaining arms 10 extending vertically downward from a bottom edge 6' portion of the annular frame member 6, as can be seen in FIGS. 1 & 3. The retaining arms 10 can be connected to (or otherwise formed with) the bottom edge portion of the annular frame member 6, at rotationally spaced apart locations along the annular frame member 6, equidistant from one another with centerline longitudinal axes of the retaining arms 10 located about one hundred and twenty (120) degrees apart from each other along the annular frame member 6.

Referring to FIG. 1, the reflective roof 8 can have three downwardly slopped arms 12 connected to (or otherwise formed with) the outer perimeter 8' of the reflective roof 8. The outer perimeter 8' of the reflective roof 8 can also be downwardly slopped. The downwardly slopped arms 12 can also be rotationally spaced apart along the circular reflective roof 8 at equidistant locations about the reflective roof 8, with centerline longitudinal axes of the downwardly slopped arms 12 aligned one hundred and twenty (120) degrees apart from each other. In some embodiments, opposite end portions of the downwardly slopped arms 12 connect with the annular frame member 6, at locations on the annular frame member 6 having center-points that are rotationally spaced apart from each of the retaining arms 10 at approximately sixty (60) degrees. As such, the downwardly slopped arms 12 can be connected to the annular frame member 6 in rotationally staggered relation to the locations of the retaining arms 10.

Figure 4A:
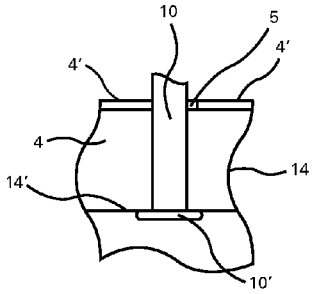
FIG. 4*a* is an outwardly facing view from line 4*a*-4*a* in FIG. 4, showing a partial view of the lantern comprising one of the retaining arms.
Figure 4B:
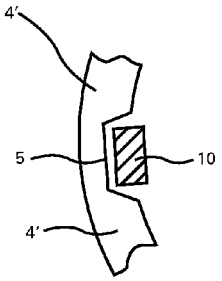
FIG. 4*b* is a downwardly facing view from line 4*b*-4*b* in FIG. 4, showing a partial view of the lip 4' of the canister having a notch 5.
Figure 4:
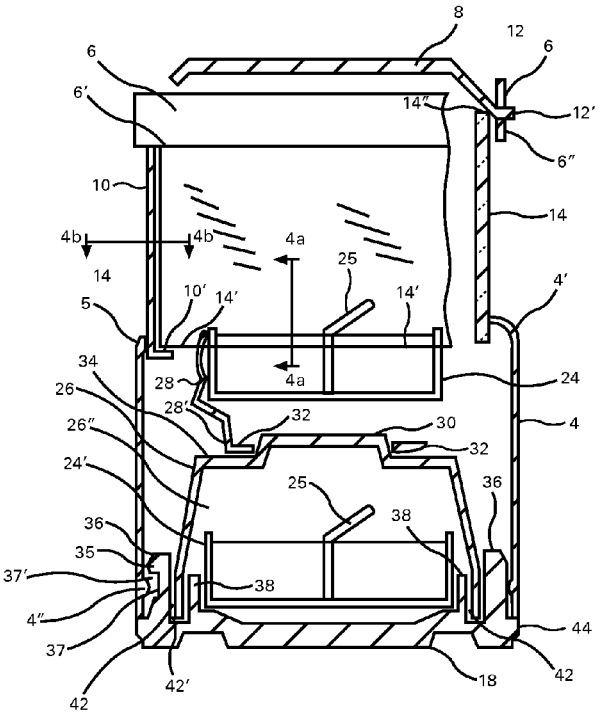
FIG. 4 is partial cross-sectional view of the lantern of FIG. 1, with the chimney in an extended position.

As shown in FIGS. 1 & 4, outer end portions of the downwardly slopped arms 12 can have connector strips 12', which can be connected to the annular frame member 6. In some embodiments, the connector strips 12' can be inserted through corresponding slit apertures 6" (e.g., three slit apertures 6") formed through the wall of the annular frame member 6. That is, for example, the downwardly slopped arms 12 can be metallic and have spring properties so as to be inwardly compressible to align the connector strips 12' with the slit apertures 6", then allowed to bias outward through the slit apertures 6" to "snap fit" the reflective roof 8 to the annular frame member 6.

Referring to FIGS. 4 & 4*a*, in some embodiments of the present disclosure, a lower edge 14' of the chimney 14 can rest at three locations on upper surfaces of three inwardly extending retaining members 10' that extend inward from bottom end portions of the corresponding retaining arms 10. In addition, as best seen in FIG. 4, a top edge 14" of chimney 14 can abut against, or be proximate to, the downwardly slopping arms 12, to securely but releasably hold the chimney 14 in place against the retaining members 10'.

Referring to FIGS. 1 & 4, various embodiments of the lantern of the present disclosure also comprise a base canister 4. The base canister 4 can be generally cylindrical in shape. A top portion of the base canister 4 can have an annular inwardly curved lip 4'. Three partial rectangular notches 5 can be cut (or otherwise formed) on the inside of the curved lip 4' as can be seen in FIGS. 1, 4 & 4*b*. The notches 5 can be located along the curved lip 4' with center points of the notches 5 being rotationally spaced apart about one hundred and twenty (120) degrees from each other along the circumference of the curved lip 4', such that the notches 4 can align with the retaining arms 10 of the chimney frame. That is, each of the retaining arms 10 can align at least partially within one of the notches 5, so as to vertically extend through the notch 10, as best seen in FIGS. 1 & 4*b*. As such, the entire chimney frame can be selectively extended and retracted with respect to the base canister 4, by sliding the retaining arms 10 through the notches 5 in the directions of arrow "A" shown in FIGS. 1, 2 & 4. That is, for example, a user can grip the annular frame member 6 in FIG. 1, and press it downward to collapse the annular frame member 6 against the curved lip 4' of the base canister 4, to retract the chimney as shown in FIG. 2, and to pull the annular frame member 6 upward to extend the chimney 14 as shown in FIG. 1. During the extension and retraction, the retaining arms 10 can slide upward or downward within the notches 5.

As best seen in FIG. 4*a*, in some embodiments of the present disclosure, the retaining members 10' located at the bottom portion of each of the retaining arms 10 can be wider than the corresponding notch 5. This allows outer portions of the retainer members 10' to abut against the curved lip 4' to prevent the retaining arms 10 from completely slipping out of the base canister 4 when the chimney 14 is extended.

Referring to FIG. 3*a*, in some embodiments of the present disclosure, a removable candle holder 31 is provided comprising a circular base 18 and a bracket assembly which includes a cup-shaped removable cap 26 and candle bracket 33, the candle bracket having a bracket ring 32 (best seen in FIG. 3), which is fitted around a circular button 30 located proximate a top wall 34 of the cap 26. A plurality of upwardly extending bracket arms 28 extend upwardly from the bracket ring 32. In some embodiments, there are three (3) bracket arms 28. The candle bracket 33 can be metallic having spring characteristics such that the bracket arms 28 can be manually biased outwardly to fit a candle 24 between the bracket arms 28, whereupon the bracket arms 28 exert inward pressure on the outside walls of the candle 24 to securely but releasably retain the candle 24. A bottom of the candle 24 can rest on mid-ridge walls 28' of the bracket arms 28, which have horizontally extending wall components.

Still referring to FIG. 3*a*, the base 18 can be circular in shape, with a bottom portion 40 having raised gripper ribs 44 formed on a circumferential perimeter portion thereof. In some embodiments, two partial annular attachment walls 36 are formed, or located, near the perimeter of the bottom portion 40 on an annular rim 41, as best seen in FIGS. 3 & 3*a*. The attachment walls 36 can be identically, or similarly, structured and rotationally spaced apart by being diametrically opposed with respect to the circular base 18, so that each portion of one attachment wall 36 is diametrically opposed to the same or similar portion on the opposite attachment wall 36.

Still referring to FIG. 3*a*, each of the attachment walls 36 can include track wall 37, bounded by an overhang wall 35 that extends radially outward further than the track wall 37, such that the track wall 37 is radially recessed with respect to the overhang wall 35. Inwardly protruding dimples 4" (See, e.g., FIGS. 3*a* & 4) formed on an inside wall of the base canister 4 of the lantern 2 can extend into the recessed area 37' defined by the track wall 37 and overhang wall 35. In particular, in some embodiments, a portion of the candle holder 31 above the raised gripper ribs 44 can be inserted within the base canister 4 as shown in FIG. 4. Thereafter, the base canister 4 can be turned such that diametrically opposed dimples 4" protruding inwardly on the base canister 4 can slide in the left pointing direction of arrow "B" shown in FIG. 3*a* into the recessed area 37'. A user can manually turn the base canister 4 until the dimples 4" abut against a downwardly extending stop 39, which can be formed on a bottom portion of the overhang wall 35, in the shape of a "V." In some embodiments, the dimple 4" abuts against the lower tip of the stop 39 but can be manually forced past the tip with minimal effort, thereby releasably securing the dimple 4" within the recessed area 37' of the track. In further embodiments, the track wall 37 can be constructed such that its radial distance from the center-point of the circular base 18 can gradually increase along the face of the wall 37 moving left direction of arrow "B" in FIG. 3*a*, such that the dimple 4" can be pressed against the track wall 37 with more pressure as the base canister 4 is turned, in order to establish a releasable friction fit between the dimple 4" and track wall 37. In some embodiments, the track wall 37 and overhang wall 35, or the entire base 18, can be made of plastic while the base canister 4 can be made of a metal, such as aluminum. Various other materials of construction may also be suitable as will be appreciated by those of ordinary skill in the art after reviewing this disclosure.

Referring to FIGS. 3 and 4, an interior annular wall 38 is provided, which is concentrically located within the partial annular attachment walls 36 and rim 41. The interior annular wall 38 can form a complete ring about the center of the base 18, and be inwardly spaced apart from the partial annular attachment walls 36 and rim 41, so as to provide partial annular gaps 42 (See, e.g., FIGS. 3*a* & 4) between the attachment walls 36 and the interior annular wall 38, and a circumference annular gap 42' between the rim 41 and the interior annular wall 38. A bottom portion 26' of the removable cap 26 can be inserted into the annular gaps 42, 42'.

Referring still to FIGS. 3 & 4, the removable cap 26 has an interior chamber 26" to accommodate a spare candle 24'. A spare candle 24' can be placed within the interior annular wall 38, to rest on an upper surface of the bottom portion 40 of the base 18, and the removable cap 26 can be placed over the spare candle 24'. In some embodiments, the bottom wall 26 of the removable cap 26 can be releasably press fit into the gaps 42, 42' to help retain the cap 26 in place, while being easily removable for a user to access the spare candle 24'. In certain embodiments, the interior chamber 26" that can accommodate a spare candle 24' can form a storage chamber that is defined by the walls of the cap 26 and the base 18, and wherein the cap 26 can be releasably secured to the base 18 by being press fit between partial annular attachment walls 36 and an interior annular wall 38.

In practice, a user of the lantern can, for example, without limitation, turn the circular base 18 in a manner (e.g., counterclockwise in some embodiments, or clockwise in others) such that the dimple 4" moves in a direction relative to the track wall and stop to release the dimple 4" from beneath the overhang wall 35 (e.g., a direction represented by the right facing portion of arrow "B" in FIG. 3*a*), to remove the candle holder 31 from the base canister 4 of the lantern 2. Thereafter, a user can either insert a first candle between the bracket arms 28 or remove a candle therefrom. Also, a user can remove the cap 26 to access a spare or stored candle 24' contained in the interior chamber 26", or to place a spare or stored candle 24' within the interior chamber 26". The user can then light the candle 24 held on the bracket arms 28 and re-secure the candle holder 31 to the base canister 4 of the lantern 2. The lantern 2 can then be used to transport or retain the burning candle 24.

Although specific embodiments and examples of the disclosure have been described supra (and in the attachments) for illustrative purposes, various equivalent modifications can be made without departing from the spirit and scope of the disclosure, as will be recognized by those skilled in the relevant art after reviewing the present disclosure. The various embodiments described can be combined to provide further embodiments. The described structures and methods can omit some elements or acts, can add other elements or acts, or can combine the elements or execute the acts in a different order than that illustrated, to achieve various advantages of the disclosure. These and other changes can be made to the disclosure in light of the detailed description.

In general, in the following claims, the terms used should not be construed to be limited to the specific embodiments disclosed in the specification. Accordingly, the invention is not limited by the disclosure, but instead, its scope is determined entirely by the following claims.

What is claimed is:

1. A lantern assembly comprising:

a chimney;

a base canister;

a first candle attached to a bracket assembly contained within the base canister;

a base to which the bracket assembly is releasably attached, with the base being releasably attached to the base canister; and a second candle stored in an interior chamber located above the base and within the bracket assembly.

2. The lantern assembly of claim 1 wherein the bracket assembly comprises a cap having a laterally extending top wall above which the first candle is connected to the bracket assembly, and wherein the interior chamber is disposed beneath the laterally extending top wall and above the base.

3. The lantern assembly of claim 2 wherein a bottom portion of the cap is releasably secured within at least one partial annular gap on the base, the partial annular gap defined by two upwardly extending walls of the base.

4. The lantern assembly of claim 3 wherein the interior chamber is defined by walls of the cap and the base.

5. The lantern assembly of claim 3 wherein the two upwardly extending walls of the base comprise an upwardly extending annular wall and at least one upwardly extending partial annular wall, with the upwardly extending annular wall being disposed circumferentially inward of the at least one upwardly extending partial annular wall.

6. The lantern assembly of claim 5 wherein the second candle is disposed within the upwardly extending annular wall.

7. The lantern assembly of claim 1 wherein the chimney can be retracted or extended with respect to the base canister.

8. A lantern comprising:

a chimney;

a base canister slidably attached to the chimney;

a first candle connected to a candle holder, the candle holder being releasably connected to the base canister; and wherein the candle holder comprises a cap releasably attached to a base, the cap having a laterally extending top wall above which the first candle is connected to the candle holder, the cap having sidewalls extending downwardly from the top wall within which a second candle is stored, the second candle being disposed above the base.

9. The lantern of claim 8 further comprising a plurality of upwardly extending partial annular walls formed on the base, the partial annular walls extending partially about an inner circumference of the base.

10. The lantern of claim 9 wherein at least one of the partial annular walls includes an overhang wall and a track wall.

11. The lantern of claim 9 further comprising an upwardly extending interior annular wall formed on the base and disposed concentrically inward of the partial annular walls.

12. The lantern of claim 11 wherein a portion of the cap is releasably connected to the base between the interior annular wall and partial annular walls.

13. The lantern of claim 8 further comprising an annular frame member and a plurality of retaining arms extending downward from the annular frame member, and further comprising radially inwardly extending retaining members positioned at end portions of the retaining arms.

14. The lantern of claim 13 wherein the base canister comprises an inwardly extending curved lip having notches through which the retaining arms extend.

* * * * *